US012618627B2

(12) United States Patent
Lee et al.

(10) Patent No.: US 12,618,627 B2
(45) Date of Patent: May 5, 2026

(54) LASER IGNITION SYSTEM FOR LARGE-CALIBER ARTILLERY

(71) Applicant: AGENCY FOR DEFENSE DEVELOPMENT, Daejeon (KR)

(72) Inventors: Yong-Seon Lee, Daejeon (KR); Sang-Tae Ahn, Daejeon (KR); Yun-Jung Oh, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 0 days.

(21) Appl. No.: 18/945,833

(22) Filed: Nov. 13, 2024

(65) Prior Publication Data

US 2025/0377179 A1 Dec. 11, 2025

(30) Foreign Application Priority Data

Jun. 10, 2024 (KR) ..... 10-2024-0074808

(51) Int. Cl.
*F41A 19/58* (2006.01)

(52) U.S. Cl.
CPC ..... *F41A 19/58* (2013.01)

(58) Field of Classification Search
CPC ..... F41A 19/58; F41A 19/63; F42B 3/113
USPC ..... 89/28.05, 28.1, 28.2
See application file for complete search history.

(56) References Cited

U.S. PATENT DOCUMENTS

| | | | | | |
|---|---|---|---|---|---|
| 3,685,392 | A * | 8/1972 | Platt | F41A 19/58 | 42/76.01 |
| 4,047,483 | A * | 9/1977 | Williams | F42C 19/0819 | 102/202 |
| 5,272,828 | A * | 12/1993 | Petrick | F41A 19/63 | 42/84 |
| 5,301,448 | A * | 4/1994 | Petrick | F42B 5/16 | 42/84 |
| 6,460,459 | B1 | 10/2002 | Mc Cahon et al. | | |
| 2003/0047101 | A1 | 3/2003 | Folsom et al. | | |

FOREIGN PATENT DOCUMENTS

| | | | | |
|---|---|---|---|---|
| CN | 114891962 | A | 8/2022 | |
| CN | 218673366 | U | 3/2023 | |
| DE | 29920266 | U1 | 3/2000 | |
| DE | 19946324 | A1 * | 3/2001 | F41A 19/63 |
| FR | 2799278 | B1 | 1/2003 | |
| KR | 10-2164993 | B1 | 10/2020 | |
| KR | 20250016786 | A * | 2/2025 | H01S 3/0007 |

OTHER PUBLICATIONS

Search Report dated Jun. 16, 2025, in European Patent Application No. 24215615.6.

* cited by examiner

*Primary Examiner* — Bret Hayes
(74) *Attorney, Agent, or Firm* — LRK PATENT LAW FIRM

(57) ABSTRACT

The present invention relates to a laser ignition system for a large-caliber artillery, which provides a linear laser beam shape, and the ignition system of the present invention evenly combusts a cylindrical large-caliber artillery propellant with a hollow center in an energy-efficient manner using a laser in longitudinal and radial directions.

19 Claims, 3 Drawing Sheets

LASER IGNITION SYSTEM FOR LARGE-CALIBER ARTILLERY

CROSS REFERENCE TO RELATED APPLICATION

The present application claims priority to Korean Patent Application No. 10-2024-0074808, filed Jun. 10, 2024, the entire contents of which is incorporated herein for all purposes by this reference.

BACKGROUND OF THE INVENTION

1. Field of the Invention

The present invention relates to a laser ignition system, and more specifically, to a laser ignition system for a large-caliber artillery, which is capable of providing a linear laser shape to quickly ignite a cylindrical artillery propellant with a hollow center.

2. Description of Related Art

Recent large-caliber artillery propellants have been developed in a cylindrical shape with a hollow center, and these propellants are characterized by being capable of efficiently increasing a speed of a shell through even combustion in longitudinal and radial directions when ignited.

In addition, research for replacing a primer in a method of igniting an artillery propellant using a laser is being recently conducted in a firearm weapon system, and this is because the use of the artillery propellant ignition method using the laser does not need a consumable primer and thus the operability of the firearm weapon system can be greatly improved. In this case, the firearm weapon system is a weapon system for converting the chemical energy of an artillery propellant into the kinetic energy of a shell to suppress distant enemies.

For example, when a large-caliber artillery propellant with a hollow center is combined with a laser ignition device, it is necessary to resolve a disadvantage of not being capable of igniting the large-caliber artillery propellant with a hollow center due to the characteristics of the laser ignition device that provides a circular shape of a linearly moving laser.

As one method for resolving this, a direction in which a laser linearly moves may be adjusted so that the energy of the laser may be transmitted to an inner wall of a cylindrical large-caliber artillery propellant with a hollow center.

Matters described above in the background art are intended to help understanding of the background of the disclosure and may include matters not related to the related art already known to those skilled in the art to which this technology pertains.

However, even when conventional laser ignition devices provide a circular laser shape, energy is transmitted only to one point of the inner wall of the large-caliber artillery propellant, and thus it takes a long time for the energy to be transmitted to the entire large-caliber artillery propellant.

Therefore, there is a need for a large-caliber artillery laser ignition system that can resolve the disadvantage of the conventional laser ignition device.

SUMMARY OF THE INVENTION

Therefore, the present invention considering this point is directed to providing a laser ignition system for a large-caliber artillery, which shortens the time for energy to be transmitted to the entire cylindrical large-caliber artillery propellant with a hollow center by changing a circular shape of a linearly moving laser into a linear laser shape and particularly, by changing a circular shape of a linearly moving laser generated from a laser source into an energy-efficient shape.

A laser ignition system for a large-caliber artillery of the present invention for achieving the above object includes a breech block coupled to a gun barrel to seal combustion gas generated by combustion, a laser transfer part mounted in front of an inclined through hole of the breech block to transfer a laser of a laser generator to an artillery, a laser diffusion part mounted behind the through hole of the breech block, and a large-caliber artillery propellant mounted inside the gun barrel and formed with a center through hole to fire a shell.

Preferably, a laser shape conversion part including a Powell lens is mounted at a front of the laser diffusion part to change a circular shape of the laser received from the laser transfer part into a linear shape, and a laser transmission part is mounted at a rear of the laser diffusion part to seal propellant combustion gas generated in the gun barrel while transmitting the converted laser received from the laser shape conversion part.

Preferably, the laser diffusion part is formed so that the rear at which the laser shape transmission part is mounted is wider than the front at which the laser shape conversion part is mounted, and an outer diameter of the laser transmission part is formed to be equal to or larger than an inner diameter of a center through hole of the large-caliber artillery propellant.

Preferably, the laser passing through the laser diffusion part causes local combustion in the large-caliber artillery propellant, in particular, the laser passing through the laser diffusion part maintains the combustion for the large-caliber artillery propellant, and when the combustion gas fills the inside of the gun barrel at a high temperature and high pressure, evenly combusts the hollow center of the large-caliber artillery propellant in longitudinal and radial directions.

Preferably, the ignition tube is installed in the center through hole of the large-caliber artillery propellant, gunpowder ignited by the energy of the laser to generate the combustion gas is applied to the inside of the ignition tube, and whether the ignition tube ignites is affected by an irradiance.

Preferably, an inner diameter portion is formed to a predetermined depth at which the front of the gun barrel is inserted to prevent the leakage of the combustion gas to an installation gap between the breech block and the gun barrel at a rear of the breech block.

In addition, a laser ignition system for a large-caliber artillery of the present invention for achieving the above object includes a laser generator configured to generate a high-power laser, a gun barrel in which combustion gas is generated by combustion, a breech block having an inner diameter portion that is inserted into the gun barrel at a predetermined depth and formed at a rear thereof and preventing the leakage of the combustion gas to an installation gap of the gun barrel, a laser transfer part mounted in front of an inclined through hole of the breech block to transfer a laser of a laser generator to an artillery, a laser diffusion part mounted behind a through hole of the breech block, a laser shape conversion part positioned at a front of the laser diffusion part and converting a circular shape of the laser into a linear shape, a laser transmission part positioned at a rear of the laser diffusion part and sealing propellant combustion gas generated in the gun barrel while transmitting the converted laser received from the laser shape conversion part, a large-caliber artillery propellant mounted inside the gun barrel and formed with a center through hole to fire gunpowder and causing local combustion using a laser passing through the laser diffusion part, and an ignition tube which is positioned in the center through hole of the large-caliber artillery propellant and to which gunpowder ignited by the energy of the laser passing through the laser diffusion part to maintain combustion is applied.

Preferably, whether the ignition tube ignites is determined by an irradiance, and when a minimum irradiance required for igniting the ignition tube is E, the irradiance of the circular laser before passing through the laser shape conversion part is $4LE/\pi d$ or more (diameter of the laser is d and an inner length of the ignition tube is L).

DETAILED DESCRIPTION OF THE INVENTION

Figure 1:
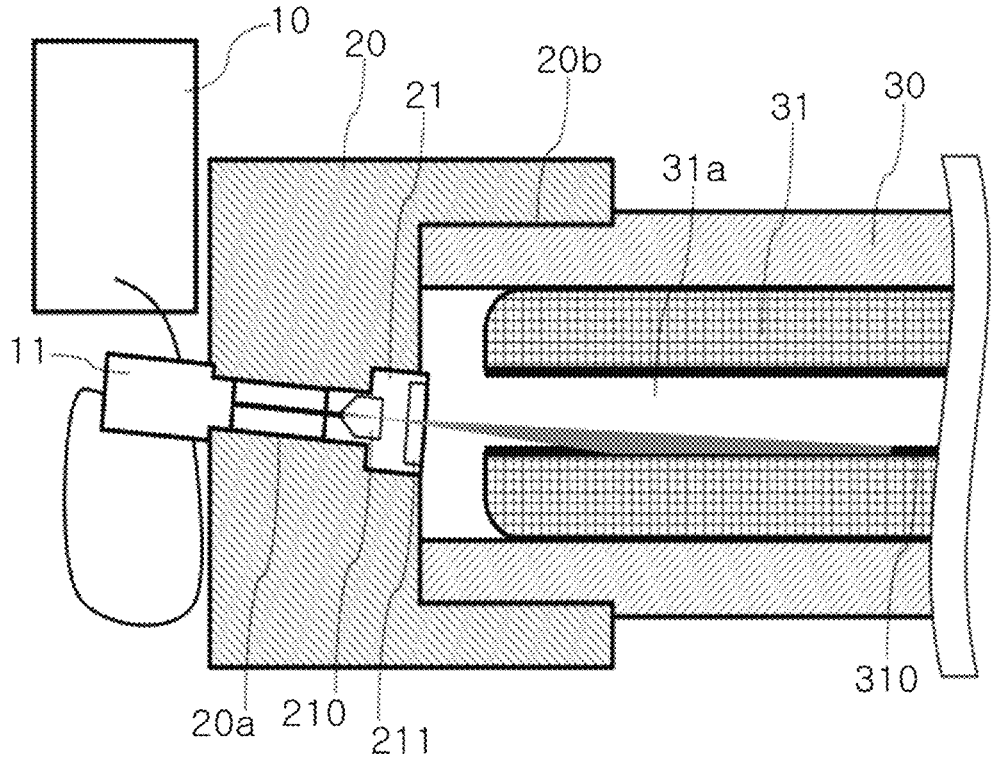
FIG. 1 is an exemplary view showing a shape of a laser ignition system for a large-caliber artillery according to the present invention.

Hereinafter, embodiments of the present invention will be described in detail with reference to the accompanying drawings, and these embodiments are examples and can be implemented in various different forms by those skilled in the art to which the present invention pertains, and thus are not limited to embodiments disclosed herein. In addition, it should be noted that the same components in each drawing may be denoted by the same reference numeral. Detailed descriptions of well-known functions and configurations that are determined to unnecessarily obscure the gist of the present invention will be omitted.

Referring to FIG. 1, the laser ignition system for a large-caliber artillery includes a laser generator 10, laser transfer/diffusion parts 11 and 21, a breech block 20, and a gun barrel 30.

For example, the laser generator 10 generates and transfers a high-power laser to the laser transfer part 11.

For example, the laser transfer/diffusion parts 11 and 21 are composed of the laser transfer part 11 for receiving the high-power laser of the laser generator 10 in a circular laser shape, and the laser diffusion part 21 for converting the circular laser shape into a linear laser behind the laser diffusion part 21 and transfers the linear laser to the gun barrel 30 of the artillery.

In particular, the laser transfer part 11 is mounted in front of an inclined through hole 20*a* of the breech block 20, and the laser diffusion part 21 is mounted behind the through hole 20*a* of the breech block 20.

In addition, the laser diffusion part 21 is provided with a laser shape conversion part 210 at a front and a laser transmission part 211 at a rear, and it is preferable that the rear of the laser diffusion part 21 is an internal space of the gun barrel 30 coupled with the breech block 20 and a large-caliber artillery propellant 31 is positioned in this space.

To this end, the rear of the laser diffusion part 21 in which the laser transmission part 211 is mounted is preferably wider than the front thereof in which the laser shape conversion part 210 is mounted.

In addition, the laser shape conversion part 210 converts a circular laser shape received from the laser transfer part 11 into a linear laser, and to this end, the laser shape conversion part 210 includes a Powell lens to convert the laser shape of the laser transfer part 11 into a linear shape.

In addition, the laser transmission part 211 seals propellant combustion gas generated inside the gun barrel while transmitting the converted laser received from the laser shape conversion part 210, and to this end, the laser transmission part 211 should not be damaged even when high-temperature and high-pressure propellant combustion gas is generated, and the linear laser generated through the laser shape conversion part 210 is preferably transmitted without energy loss as much as possible.

For example, the breech block 20 is formed with the inclined through hole 20*a* where the laser transfer part 11 and the laser diffusion part 21 are coupled, and an inner diameter portion 20*b* with a predetermined depth, and the inner diameter portion 20*b* seals the gun barrel 30 to prevent the leakage of the propellant combustion gas generated inside the gun barrel 30 when coupled with the gun barrel 30.

To this end, the inner diameter portion 20*b* is formed to a predetermined depth at which the front of the gun barrel 30 is inserted to prevent the leakage of combustion gas through an installation gap between the breech block 20 and the gun barrel 30.

For example, the gun barrel 30 is mounted on the breech block 20 to seal combustion gas and includes a large-caliber artillery propellant 31 that is mounted therein and has a center through hole 31*a* formed to fire a shell.

For example, the large-caliber artillery propellant 31 has a hollow shape by including an ignition tube 310 at the center, and gunpowder ignited by laser energy received through the laser transmission part 211 to generate combustion gas is applied to an inner wall of the ignition tube 310.

To this end, an outer diameter of the laser transmission part 211 is formed to be equal to or larger than an inner diameter of the center through hole 31*a* of the large-caliber artillery propellant 31.

In addition, since the large-caliber artillery propellant 31 has the ignition tube 310 applied to the center, the laser received through the laser diffusion part 21 ignites a portion of the ignition tube 310 to generate combustion gas.

In addition when the ignition tube 310 does not stop combustion after ignition, the ignition tube 310 continuously generates combustion gas, and the combustion gas fills the internal space of the gun barrel 30 in a high-temperature and high-pressure state, and in this process, all uncombusted parts of the ignition tube 310 ignite, causing combustion gas to be generated more explosively, and in a chain reaction, the entire large-caliber artillery propellant 31 is combusted.

Figure 2:
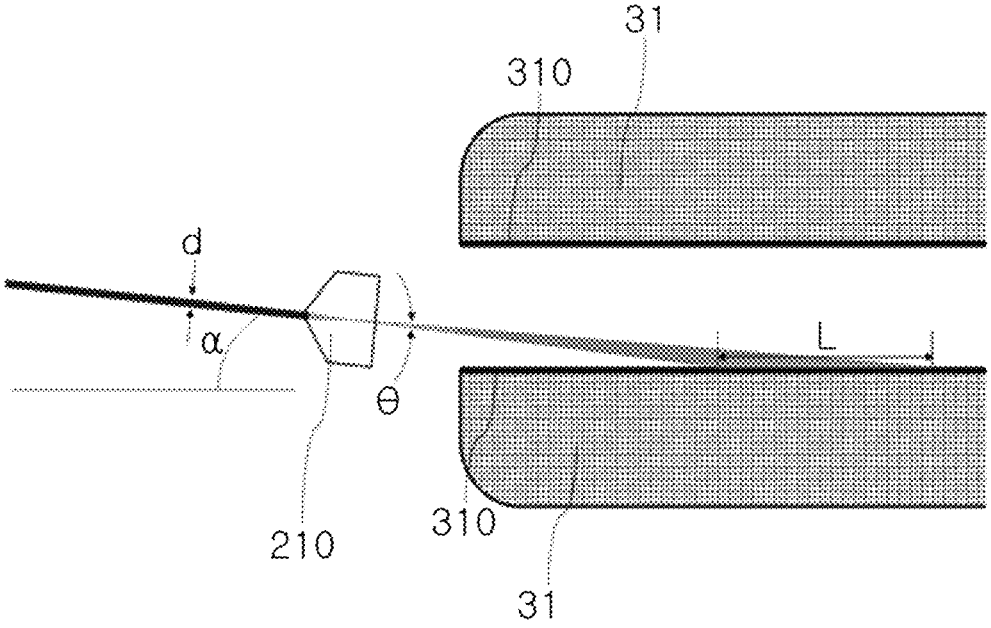
FIG. 2 is an exemplary view for describing a laser shape conversion part of the laser ignition system for a large-caliber artillery according to the present invention.

Referring to FIG. 2, conditions for igniting the ignition tube 310 and irradiance conditions are exemplified.

For example, as the conditions for igniting the ignition tube 310, when the laser received through the laser transfer part 11 has a shape with a diameter of d and a cross-sectional area of $d^2\pi/4$ and passes through the laser shape conversion part 210 including the Powell lens in the example, the laser is changed into a linear shape that has a width of d and spreads at an angle of θ and is in contact with the inside of the ignition tube 310 by a length L, and thus an area that the laser is in contact with the inside of the ignition tube 310 becomes dL.

In addition, since whether the ignition tube 310 ignites is affected by irradiance inversely proportional to an area, when the minimum irradiance required for ignition of the ignition tube 310 is E, the irradiance of the circular laser before the laser passes through the laser shape conversion part 210 needs to be $4LE/\pi d$ or more.

Considering these conditions, repeated experiments are performed, and based on the result of these repeated experiments, a laser entry angle α, a laser diameter d, a diffusion angle θ, and laser power may be set so that the combustion does not stop after the ignition tube 310 ignites.

Figure 3:
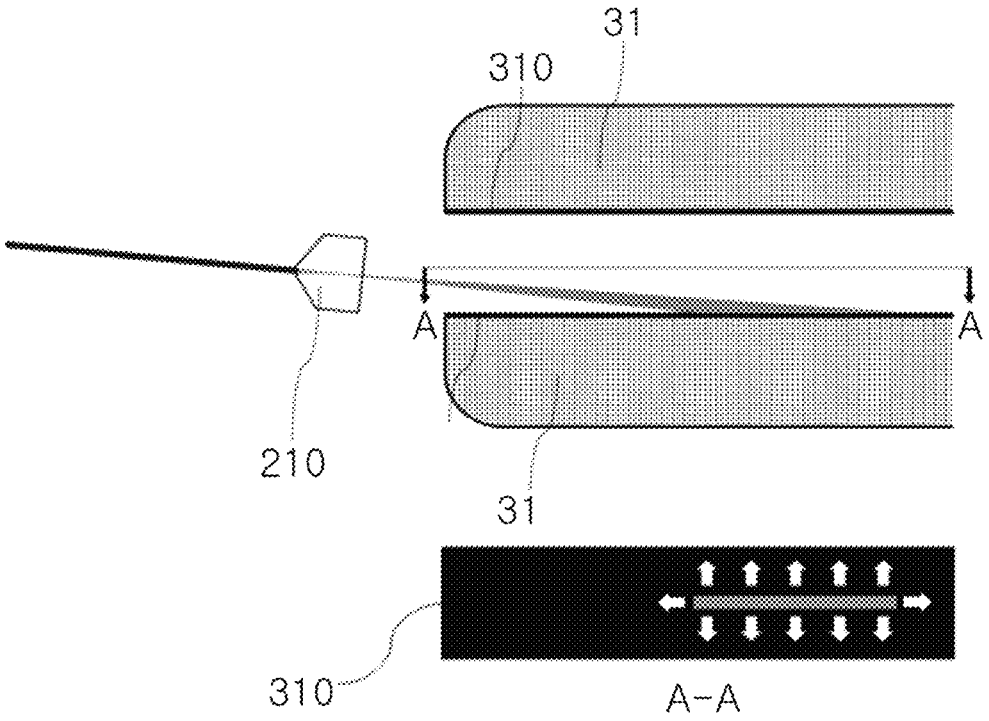
FIG. 3 is an exemplary view for describing a combustion phenomenon when the laser ignition system for a large-caliber artillery according to the present invention ignites a large-caliber artillery propellant.

Referring to FIG. 3, when the laser ignition system for a large-caliber artillery ignites the large-caliber artillery propellant 31, initially, local combustion occurs in a portion of the ignition tube 310 exposed to the laser as in a cross section A-A in a direction of arrow A.

During this combustion, when combustion does not stop, a combustion area expands in the direction of arrow A, combustion gas is continuously generated, and when the combustion gas is sufficiently generated and a high-temperature and high-pressure environment is established inside the gun barrel 30, combustion occurs in the entire ignition tube 310, and the large-caliber artillery propellant 31 is evenly combusted in longitudinal and radial directions in a chain reaction.

In this way, there are advantages that the laser ignition system for a large-caliber artillery of the present invention can minimize the energy of the laser source by changing the shape of the linearly moving laser beam into the linear laser beam shape to ignite the cylindrical large-caliber artillery propellant with a hollow center, and evenly combust the hollow center of the large-caliber artillery propellant 31 in the longitudinal and radial directions.

Therefore, the core technology of the present invention through FIGS. 1 to 3 is to maximize the area of the portion exposed to the laser of the ignition tube 310 by changing the cross-sectional area of the laser using the laser shape conversion part 210 including the Powell lens in the example, thereby expanding the local combustion area (e.g., cross-section A-A of FIG. 3).

The laser ignition system for a large-caliber artillery of the present invention can minimize the energy of the laser source by changing the circular shape of the linearly moving laser beam into the linear laser beam shape and ignite the circular artillery propellant with a hollow center.

In particular, the laser ignition system for a large-caliber artillery of the present invention can use the laser shape conversion part including the Powell lens for a change in cross-sectional area of the laser in order to maximize the area of the portion exposed to the laser in the ignition tube to enable an expansion of the local combustion area.

Meanwhile, the present invention is not limited to the above-described embodiments, but may be implemented through modifications and changes without departing from the gist of the present invention, and the technical spirit to which such modifications and changes are added should also be considered as falling within the scope of the appended claims.

What is claimed is:

1. A laser ignition system for a large-caliber artillery propellant, comprising:

a breech block coupled to a gun barrel to seal combustion gas generated by combustion;

a laser transfer part mounted in front of an inclined through hole of the breech block to transfer a laser from a laser generator to the large-caliber artillery propellant;

a laser diffusion part mounted behind the through hole of the breech block; and the large-caliber artillery propellant mounted inside the gun barrel and formed with a center through hole for firing a shell.

2. The laser ignition system of claim 1, wherein a laser shape conversion part is mounted at a front of the laser diffusion part, and the laser shape conversion part converts a circular shape of the laser received from the laser transfer part into a linear shape.

3. The laser ignition system of claim 2, wherein the laser shape conversion part includes a Powell lens.

4. The laser ignition system of any one of claim 3, wherein the laser diffusion part is formed so that the rear at which the laser transmission part is mounted is wider than the front at which the laser shape conversion part is mounted.

5. The laser ignition system of claim 2, wherein a laser transmission part is mounted at a rear of the laser diffusion part, and the laser transmission part seals propellant combustion gas generated in the gun barrel while transmitting the converted laser received from the laser shape conversion part.

6. The laser ignition system of claim 5, wherein an outer diameter of the laser transmission part is formed to be equal to or larger than an inner diameter of a center through hole of the large-caliber artillery propellant.

7. The laser ignition system of any one of claim 6, wherein the laser diffusion part is formed so that the rear at which the laser transmission part is mounted is wider than the front at which the laser shape conversion part is mounted.

8. The laser ignition system of any one of claim 5, wherein the laser diffusion part is formed so that the rear at which the laser transmission part is mounted is wider than the front at which the laser shape conversion part is mounted.

9. The laser ignition system of any one of claim 2, wherein the laser diffusion part is formed so that the rear at which the laser transmission part is mounted is wider than the front at which the laser shape conversion part is mounted.

10. The laser ignition system of claim 1, wherein the laser passing through the laser diffusion part causes local combustion in the large-caliber artillery propellant.

11. The laser ignition system of claim 10, wherein the laser passing through the laser diffusion part maintains the combustion for the large-caliber artillery propellant, and when the combustion gas in the gun barrel reaches temperatures and pressures sufficient to ignite remaining propellant, combustion proceeds in both longitudinal and radial directions in the center through hole of the large-caliber artillery propellant.

12. The laser ignition system of claim 1, wherein an ignition tube is installed on the large-caliber artillery propellant, and the ignition tube is positioned in the center through hole of the large-caliber artillery propellant.

13. The laser ignition system of claim 12, wherein gunpowder ignited by energy of the laser to generate the combustion gas is applied to an inside of the ignition tube.

14. The laser ignition system of claim 12, wherein whether the ignition tube ignites is determined by an irradiance.

15. The laser ignition system of claim 1, wherein an inner diameter portion is formed at a rear of the breech block, and the inner diameter portion is formed to a predetermined depth at which a front of the gun barrel is inserted to prevent leakage of the combustion gas into an installation gap between the breech block and the gun barrel.

16. A laser ignition system for a large-caliber artillery propellant, comprising:

a laser generator configured to generate a laser;

a gun barrel in which combustion gas is generated by combustion;

a breech block having a rear inner diameter portion into which a front of the gun barrel is inserted, thereby preventing leakage of the combustion gas to an installation gap of the gun barrel;

a laser diffusion part mounted behind a through hole of the breech block;

a laser shape conversion part positioned at a front of the laser diffusion part and converting a circular shape of the laser into a linear shape using a Powell lens;

a laser transmission part positioned at a rear of the laser diffusion part and sealing propellant combustion gas generated in the gun barrel while transmitting the converted laser received from the laser shape conversion part; and a large-caliber artillery propellant mounted inside the gun barrel, formed with a center through hole, and causing local combustion using the converted laser passing through the laser diffusion part.

17. The laser ignition system of claim 16, wherein the laser diffusion part is formed so that the rear at which the laser transmission part is mounted is wider than the front at which the laser shape conversion part is mounted, and an outer diameter of the laser transmission part is formed to be equal to or larger than an inner diameter of a center through hole of the large-caliber artillery propellant.

18. The laser ignition system of claim 16, wherein, when the combustion gas in the gun barrel reaches temperatures and pressures sufficient to ignite remaining propellant, combustion proceeds in both longitudinal and radial directions in the center through hole of the large-caliber artillery propellant.

19. The laser ignition system of claim 16, wherein an ignition tube is installed on the large-caliber artillery propellant, and whether the ignition tube ignites is determined by an irradiance, and wherein when a minimum irradiance required for igniting the ignition tube is E, the irradiance of the circular laser before passing through the laser shape conversion part is $4LE/\pi d$ or more, where diameter of the laser is d and an inner length of the ignition tube is L.

* * * * *